US007222779B1

(12) United States Patent
Pineda-Sanchez et al.

(10) Patent No.: US 7,222,779 B1
(45) Date of Patent: May 29, 2007

(54) SECURITY MAIL BOX ASSEMBLY

(76) Inventors: Juan Ramon Pineda-Sanchez, 480 Julian St., Turlock, CA (US) 95380; Maria Garcia-Pineda, 480 Julian St., Turlock, CA (US) 95380

( * ) Notice: Subject to any disclaimer, the term of this patent is extended or adjusted under 35 U.S.C. 154(b) by 21 days.

(21) Appl. No.: 10/839,270

(22) Filed: May 4, 2004

(51) Int. Cl.
*A47G 29/12* (2006.01)

(52) U.S. Cl. ..... 232/36; 340/569

(58) Field of Classification Search ..... 232/17, 232/45, 34–36, 19; 340/569
See application file for complete search history.

(56) References Cited

U.S. PATENT DOCUMENTS 3,611,333 A * 10/1971 Conigliaro ..... 340/539.14
4,934,592 A * 6/1990 DiMenichi ..... 232/17
5,917,411 A * 6/1999 Baggarly ..... 340/569
5,950,919 A * 9/1999 Adams ..... 232/34
6,318,628 B1 * 11/2001 Pangburn ..... 232/17
6,831,558 B1 * 12/2004 Andrew ..... 340/539.2

* cited by examiner

*Primary Examiner*—William L. Miller

(57) ABSTRACT

The security mailbox assembly functions to prevent identity and mail theft. The security mailbox assembly comprises a lockable mailbox having an internal alarm system functioning in cooperation with a receiver, a remote control transmitter, and an outgoing mail holder including an additional receiver.

2 Claims, 5 Drawing Sheets

SECURITY MAILBOX ASSEMBLY.

SECURITY MAILBOX ASSEMBLY.

THE OUTGOINGMAIL HOLDER

60.

54.

THE SECURITY MAILBOX SCHEMATIC DIAGRAM.

OUTGOING MAIL HOLDER SCHEMATIC DIAGRAM.

SECURITY MAIL BOX ASSEMBLY

BACKGROUND OF THE INVENTION

1. Field of the Invention

The present invention relates to mail box assemblies and more particularly pertains to a new security mail box assembly for providing a user with a modified mailbox which will truly protect and secure your mail, by incorporating a security alarm device completed with a motion sensor, and a pager. (pager can be optional)

2. Description of the Prior Art

The use of mailbox assemblies is known in the prior art. U.S. Pat. No. 4,363,439 describes as a mail delivery signal device detached rural-type mailboxes wherein an elongated signal arm member, swingably secured along its lower end to a lower front portion of the mailbox so as to lean abuttingly thereagainst at its upper end, falls arcuately downwardly to project beyond the bottom or either side of the mailbox, selectively, upon the door being opened or the delivery of mail, thereby automatically notifying the recipient that mail has been delivered. Another type of mailbox assembly is U.S. Pat. No. 4,344,559 describes a mailbox has a hinged front gate with a casing receiving a flag with lateral play for movement into raised and lowered positioned to indicate "no mail" and "mail delivery", respectively. Provided on the flag and box are two ferromagnetic strips, respectively, of which at least one is a permanent magnet, with these strips being coordinated to be in the raised flag positioned in magnetic engagement for supporting the flag, and the strip on the flag will on opening of the gate turn with the latter and thereby disengage from the strip on the box for release of the flag for its gravitational drop to its lowered position. Another type of mailbox assembly is U.S. Pat. No. 4,706,880 describes a rural mailbox structure including a "mail-in" signaling elements that is operable to protrude laterally sideways apparent and visually apparent from the front and or rear when the mailbox is opened by rotation of the front door. Apparatus is included to maintain the signal element in the cocked unobservable positioned by a trigger rod engaged in an aperture in the signal element, which is disengaged when the front door is opened. Another type of mailbox is U.S. Pat. No. 4,708,286 describes a mail-call signal device secured to the exterior of a typical rural or curbside mailbox door to indicate the presence of mail. When the mail carrier opens the mailbox door the face plate and signal plate rotate downward permitting the bright orange signal to be thrust outward and downward by spring means to a fully extended position visible from all directions. The signal device is reset with one finger applying pressure to the bottom of the signal plate in the upward position. U.S. Pat. No. 6,708,875 describes an improved mailbox signal comprises a case having a slide disposed therein. A catch on the slide engages a detent on the case interior and the slide hangs suspended from the detent when the case is in substantially vertical orientation. When the case is rotated forward to a substantially horizontal position, the catch and detent disengage, freeing the slide to fall when the case is returned to the vertical. In embodiment, the device may allow the slide to partially project from the bottom of the case or may allow the slide to fall from the case, and/or hang suspended by a tether. U.S. Pat. No. 6,694,580 A mail notification system for use with structures and residences is disclosed. The mail notification system comprises an activator attachment that is attached to an inner surface of a mailbox. The activator attachment includes an activator that is kept in a retracted positioned by a flange attached to a mailbox door when the mailbox door is shut. Once the mailbox door is opened, the activator opens to an extended position, thereby activating a radio wave transmitter in the activator attachment. The radio wave transmitter emits radio waves that are picked up by a radio wave receiver that is incorporated into a face plate unit that is preferably located within a residence of an individual. The radio wave receiver then activates a speaker to emit sounds and an attached display to display words that indicates the mailbox door has been opened, suggesting mail has been deposited in the mailbox. While these devices fulfill their respective, particular objectives and requirements, the need remains for a device that includes that has certain improved features.

SUMMARY OF THE INVENTION

The present invention concerns that of a new and improved Security Mailbox Assembly, guaranteed to help prevent identity and mail theft.

For use with rural, residential and any other type of mailbox desired, The Security Mailbox Assembly having at least one inner surface, two ends (front, back) two side panels (right, left) top and bottom surfaces, and a coverlid or opening door with a handle on it. The top surface of the Security Mailbox will have a mail deposit aperture and lockable bracket, in the shape of a small square welded on two ends design for the lockable device to lock through the two non welded sides of the square, providing a better protection to the Security Mailbox. The lockable bracket will be welded in the inner side of the top surface. The Security Mailbox Assembly will comprise a lockable compartment equipped with a special design compact weatherproof protected mailbox's alarm system that will be mounted inside the inner surface of the Security Mailbox Assembly. The mailbox's alarm system will have adjustable impact and motion sensors that will trigger the mailbox's alarm system if Security Mailbox is being tampered with. The Security Mailbox will also be equipped with either pin switches or magnetic switches connected to the mailbox's alarm system, to protect the Security Mailbox deposit lockable compartment and coverlid or opening door. When the coverlid or opening door opens, the mailbox alarm system will trigger a signal to a radio wave receiver (pager), which will indicate that mail has arrived. If somebody would to attempt to force the mail deposit lockable compartment open, the mailbox's alarm system will activate and emit loud sounds subsequently will transmit a radio wave signal to a receiver pager device to alert that somebody is tampering with The Security Mailbox. Only the person with the remote control (transmitter) will be able to activate or deactivate mailbox alarm (on/off). The radio wave (transmitter)/pager, preferable located within an individual, as second option a radio wave receiver/pager, can be built into an outgoing mail holder with a (LCD) screen display and signal light (LED), to provide sound and visual effects. The outgoing mail/radio wave receiver (pager), located within a residence, would work on conventional house powered with a battery back-up power attachments to provide back up power if lights goes out, and it would work as follow:

You would place your outgoing mail into the outgoing mail holder with the radio wave receiver/pager when Security Mailbox coverlid or opening door opens, the Security Mailbox's alarm system would send a signal to the outgoing mail holder/radio wave receiver/pager, letting you know that your mail has been delivered, Then you would get your mail and take it personally to the Postal Service delivery person, that would solve the mail theft problem because you would receive your mail as soon as it gets to your Security Mailbox and you would send the outgoing mail at the same time.

The Security Mailbox will also have incorporated (LED) light to aware any passerby or potential thief that The Security Mailbox mechanism is functioning. Also the Security Mailbox can be insolated to prevent from shorting out incase somebody would to attempt purposely short it out by electrical shock.

That has thus been outlined, rather broadly, the more important features of The Security Mailbox that the detailed description thereof that follows may be better understood and in order that the presence contribution to the art may be better appreciated. There are, of course, additional features of The Security Mailbox that will be described hereinafter and which will form the subject matter of the claims appended hereto. In this respect, before explaining at least one embodiment of The Security Mailbox Assembly in detailed, it is to be understood that the Security Mailbox Assembly is not limited in it's application to the details of constructions and to the arrangements of the components set forth in the following description or illustrated in the drawings. The Security Mailbox Assembly is capable of other embodiments and being practices and carried out in various ways further, since numerous modifications and changes will readily occur to those skilled in the art, it is not desired to the limit the invention to the exact construction and operations shown and accordingly, all suitable modifications and equivalents may be resorted to, falling within the scope of the invention. It's also, to be understood that the phraseology and terminology employed herein are for the purpose of the descriptions and shall not be regarded as limiting.

It is an object to present invention to provide a new non existing Security Mailbox Assembly which has all the advantages of prior art and none of disadvantage.

It is an object to the present invention to provide a new non-existing mailbox's alarm system to be mounted inside any existing mailbox desired examples: rural mailbox, residential etc.

It is an object of the present invention to provide a new non existing device which will be a combination of: outgoing mail holder/radio wave receiver (pager), with a (LCD) screen display and a signal light (LED) as optional, that will notify you when mail has been delivered.

It is an object of the present invention to provide The Security Mailbox Assembly, which may be easily and more efficient to manufactured and marketed.

It is an object of the present invention is to truly provide a 24-hour mail protection It is an object of the present invention to aware any passerby or potential thief that The Security Mailbox is armed with an alarm device to keep them away from your mail.

Yet the most important object of the present invention is to stop the mail theft and especially identity theft.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
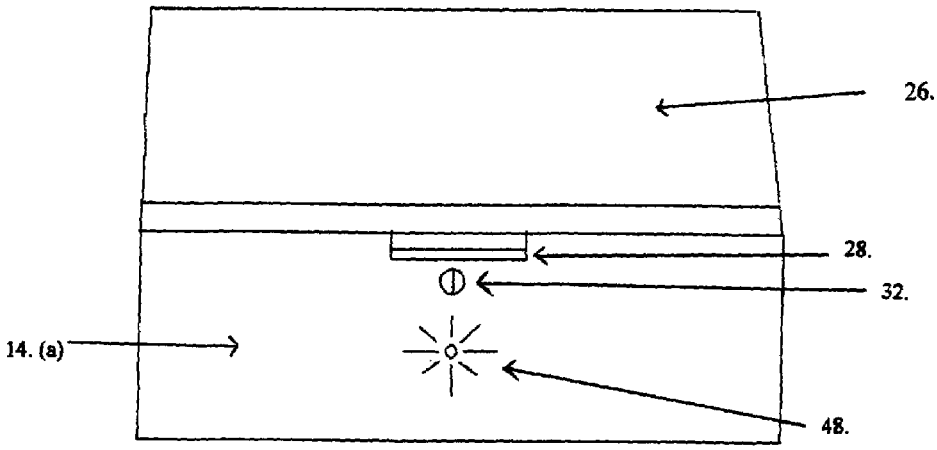
FIG. 1 is a front view of a residential security mailbox.
Figure 2:
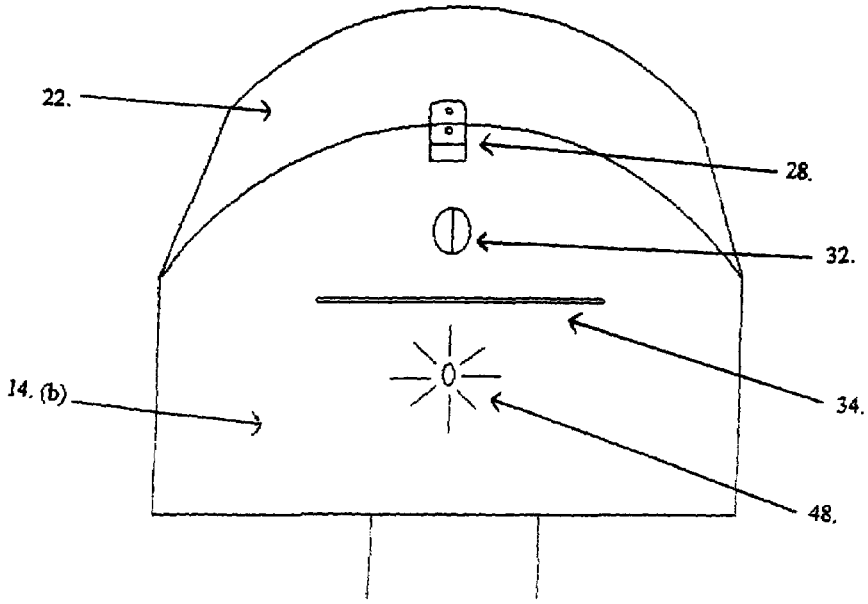
FIG. 2 is a front view of a rural security mailbox.
Figure 3:
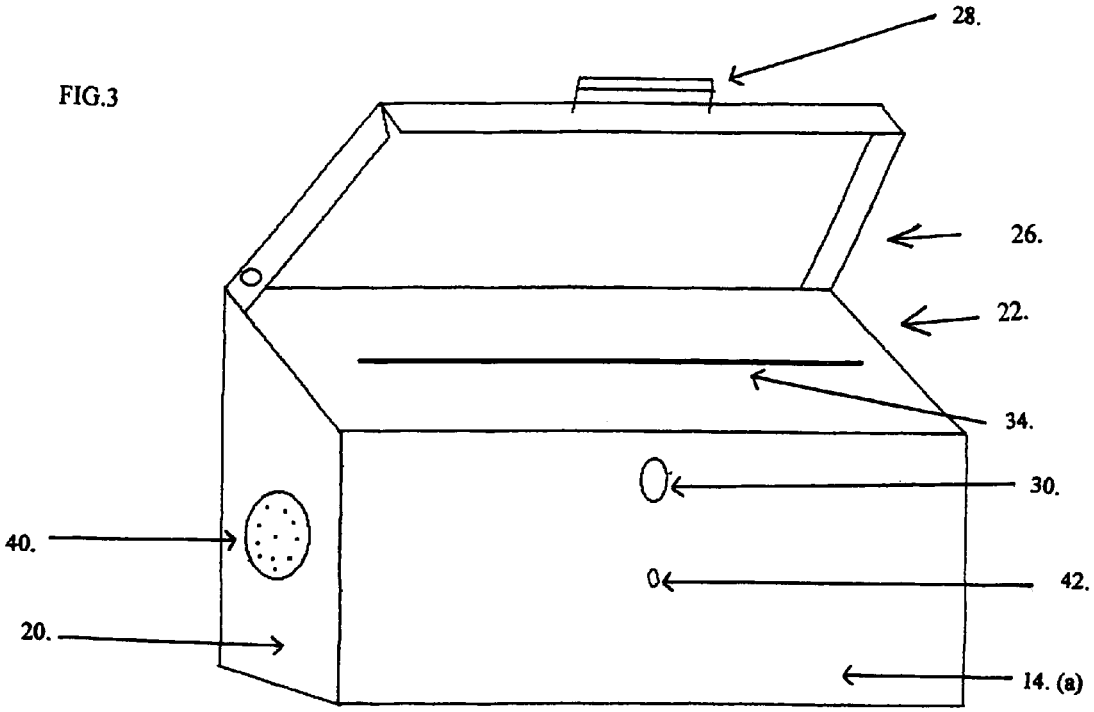
FIG. 3 is a view of the residential security mailbox with the lid open.

Residential Security Mailbox:

As best illustrated in FIGS. 1 through 3, the Security Mailbox Assembly generally comprising a mailbox, the mailbox having at least one inner surface, the mailbox having two ends, a front end 14(*a*), and back end, two side panels, right side, and left side 20, top and bottom surfaces, top surface 22, and bottom surface, and a cover lid 26, with a handle on it 28. the Security Mailbox, will also comprise a lockable aperture 30, where a locking device 32, will be placed.

On the top surface 22, of The Security Mailbox, will have a mail deposit aperture 34, also lockable bracket. The mail deposit aperture 34 will be placed on the middle section of the top surface 22, The lockable bracket, will be welded in the inner surface, of the top surface 22, of The Security Mailbox, The lockable bracket, will work coupled to the locking device 32, providing a locking compartment.

The Security Mailbox, will also have smalls outgoing sound apertures 40, and signal light aperture 42.

Figure 5:
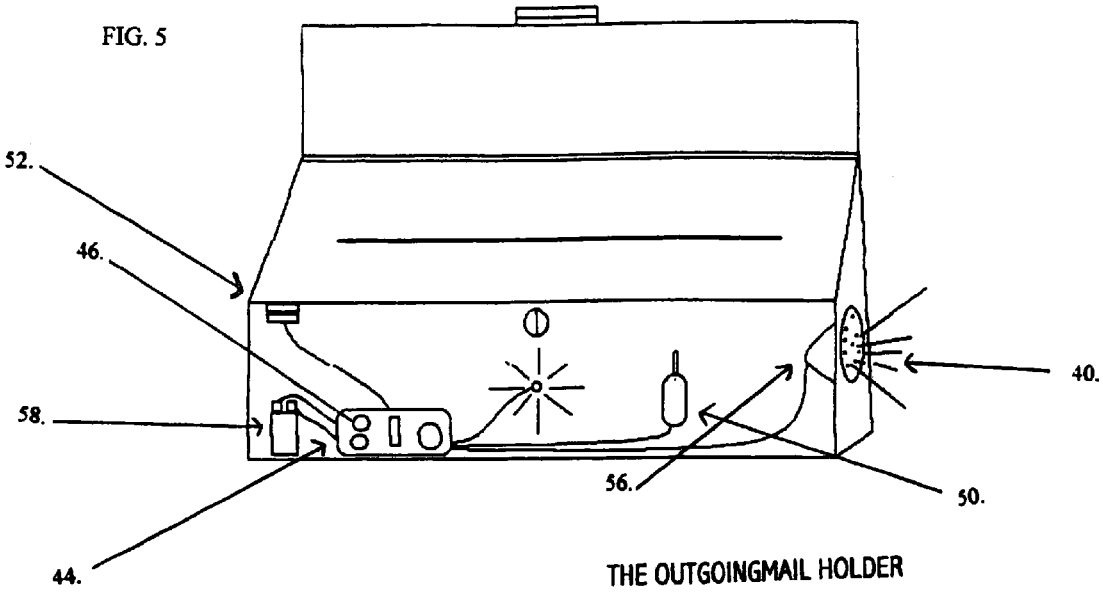
FIG. 5 is an inside view of the residential security mailbox showing the alarm system.

As shown in FIG. 5, a special designed compact, weatherproof, protected, mailbox alarm system 44, will be mounted inside the inner surface, of the Security Mailbox, The mailbox alarm system 44, will have adjustable impact and motion sensor 46, that will trigger the mailbox alarm system 44, Security Mailbox, is being tampered with.

The Security mailbox, will also have incorporated an (LED) signal light 48, placed Through the signal light aperture 42, on the front end 14(*a*), of the Security Mailbox. (LED) signal light 48, to aware any passerby or potential thief that the Security Mailbox, is functioning.

The Security Mailbox, will have an antenna 50, to provide a better radio wave signal transmission. The Security Mailbox, will also be equipped with either pin switches or magnetic switches 52, connected to the mailbox alarm system 44, to protect the Security Mailbox lockable compartment, and cover lid 26.

Figure 7:
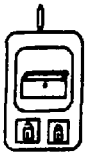
FIG. 7 is a receiver.

When the cover lid 26, opens, the mailbox alarm system 44, would trigger a radio wave signal to a radio wave receiver (FIG. 7) 54, which will indicate that the mail has arrived, if somebody would attempt to force the locking compartment, open, the mailbox alarm system 44, will activate and emit loud sounds through a multi-tone siren or speaker 56, preferable mounted facing out attached on the smalls outgoing sound apertures 40, subsequently the mailbox alarm system 44, will transmit a radio wave signal to the radio wave receiver/pager 54, to alert that somebody is tampering with the Security Mailbox.

DESCRIPTION OF THE PREFERRED EMBODIMENT

Figure 4:
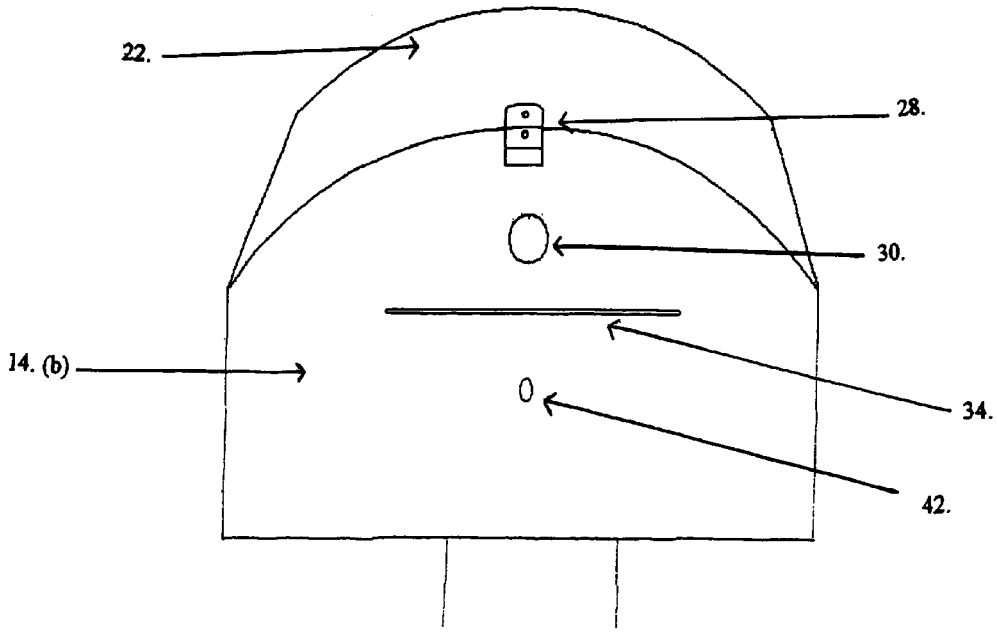
FIG. 4 is a front view of the rural security mailbox.

Rural Security Mailbox:

As best illustrated in FIGS. 2 and 4, and using the same reference numerals for similar elements of the assembly, the Security Mailbox Assembly generally comprising a mailbox, the mailbox having at least one inner surface, the mailbox having two ends, front cover, (opening door) 14(*b*), and back end, two side panels, right side, and left side 20, top and bottom surfaces, top surface 22, and bottom surface, opening door handle 28.

The front cover, (opening door) 14(*b*), of the Security Mailbox, will also comprise a lockable aperture 30, where a lockable device 32, will be placed. On the front cover, (opening door) 14(*b*), of The Security Mailbox will have a mail deposit aperture 34, and a lockable bracket. The deposit mail aperture 34 will be placed on the middle section of the front cover, (opening door) 14(*b*), and the lockable bracket, will be welded in the inner surface, of the top surface 22, of The Security Mailbox, the lockable bracket, will work coupled to the locking device 32, providing a locking compartment.

The Security Mailbox, will also have smalls outgoing sound apertures 40, and signal light aperture 42.

As shown in FIG. 5, and as previously described with reference to the residential security mailbox, a special designed compact, weatherproof, protected, mailbox alarm system 44, will be mounted inside the inner surface, of the Security Mailbox, The mailbox alarm system 44, will have adjustable impact and motion sensor 46, that will trigger the mailbox alarm system 44, if Security Mailbox, is being tampered with.

The Security mailbox, will also have incorporated an (LED) signal light 48, placed through the signal light aperture 42, on the front cover (opening door) 14(*b*), of the Security Mailbox. (LED) signal light 48, to aware any passerby or potential thief that the Security Mailbox is functioning.

The Security Mailbox, will have an antenna 50, to provide a better radio wave signal transmission. The Security Mailbox, will also be equipped with either pin switches or magnetic switches 52, connected to the mailbox alarm system 44, to protect the Security Mailbox lockable compartment.

If somebody would attempt to force the locking compartments opens, the mailbox alarm system 44, would activate a signal to a receiver/pager 54, and emit loud sounds through a multi-tone siren or speaker 56, preferable mounted facing out attached on the smalls outgoing sound apertures 40.

When mail is deposit through the mail deposit aperture 34, the mailbox alarm system 44, would register a signal subsequently would trigger a radio wave signal to the receiver (FIG. 7) 54, which will indicate the mail has arrived, if somebody would to attempt the locking compartment open, the mailbox alarm system 44, would activate and emit loud sounds through a multi-tone siren or speaker 56, preferable mounted facing out attached on the small outgoing sound apertures 40, subsequently the mailbox alarm system 44, will transmit a radio wave signal to the radio wave receiver/pager 54, to alert that somebody is tampering with the Security Mailbox.

The Security Mailbox, will work by battery power operated. A battery or batteries will be attached to a battery attachments 58, to supply power to Security Mailbox.

Figure 6:
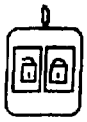
FIG. 6 is a remote control transmitter.

As shown in FIG. 6, a radio wave remote control transmitter 60, will work coupled to the mailbox alarm system 44, to activate and deactivate mailbox alarm system 44, (on/off). The radio wave remote control transmitter 60, preferable located within an individual.

Figure 8:
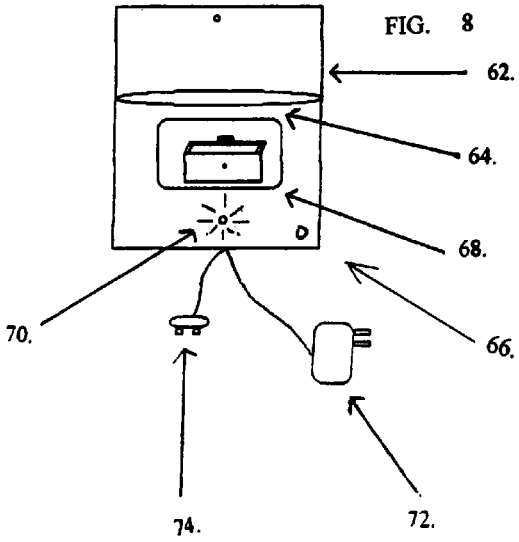
FIG. 8 is an outgoing mail holder/receiver.
Figure 9:
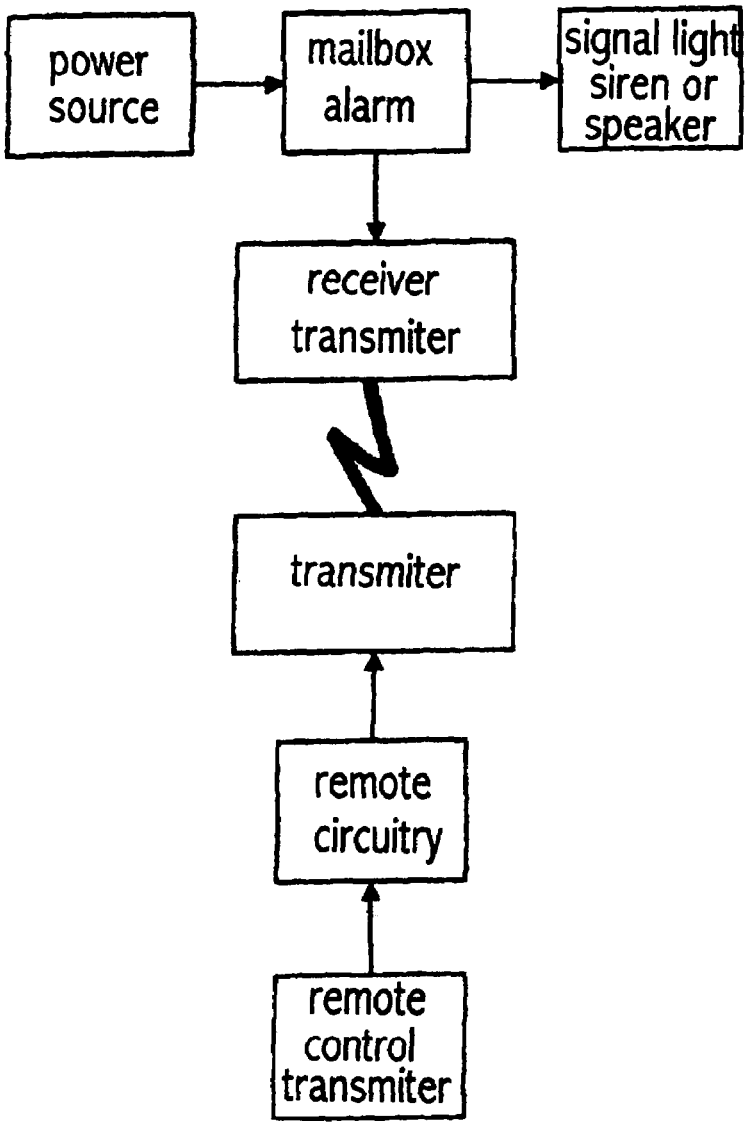
FIG. 9(A) is the security mailbox schematic diagram.
FIG. 9(B) is the outgoing mail holder/receiver schematic diagram.
Figure 9:
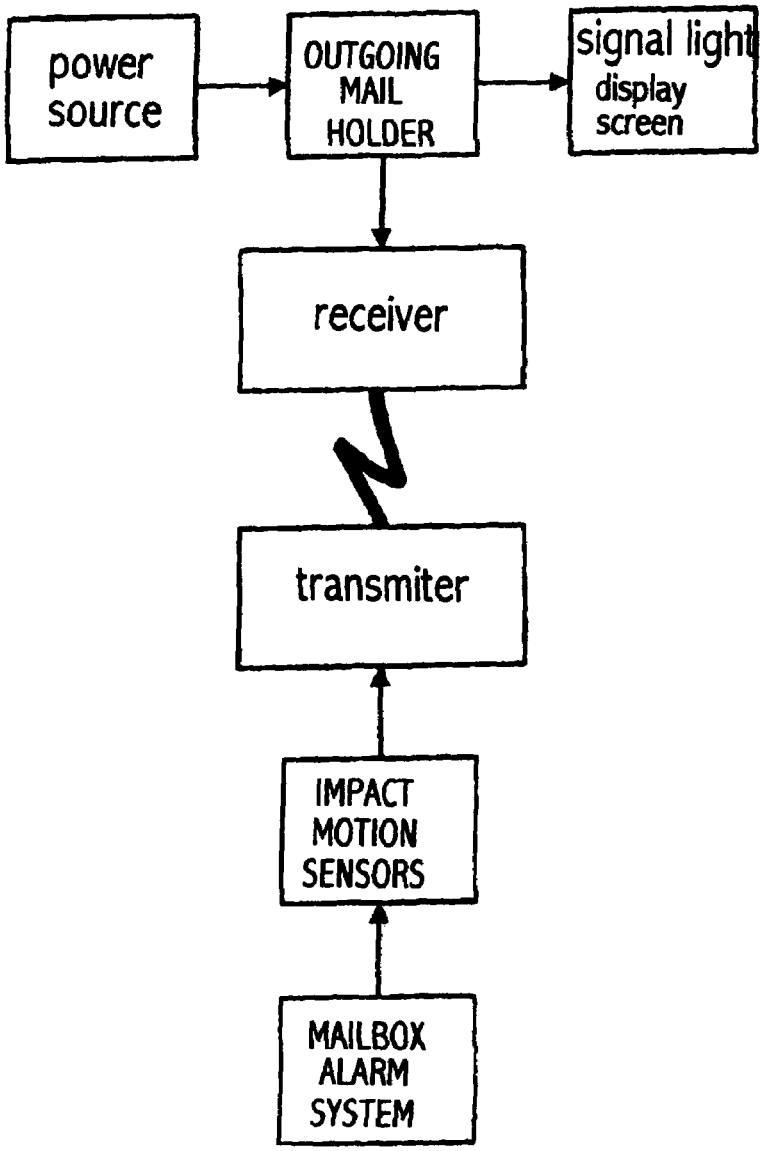

As shown in FIG. 8, a working coupled to the mailbox alarm system 44, will be a new device for outgoing mail which will be an outgoing mail holder/radio wave receiver (pager) 62.

THE OUTGOING MAIL HOLDER/RADIO WAVE RECEIVER (PAGER) will comprise:

An outgoing mail holder 64, were you would place your outgoing mail.

A radio wave receiver 66, to receiver transmission from the Security Mailbox 10, Display screen (LCD) 68, to provide you with visual effect Signal light (LED) 70, to signal when Security Mailbox 10, has been triggered Power supply (AC-DC ADAPTER) 72, to supply power to the outgoing mail holder/radio wave-receiver (pager) 62.

Back-up battery attachments 74, to provide back-up power in case house power goes out.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not described to limit the invention to the exact construction and operation shown and described, and accordingly, all suitable modifications and equivalents may be restored to, falling within the scope of the invention.

We claim:

1. A residential security mailbox assembly comprising:

a mailbox having a front, back, two sides, openable top, and bottom collectively defining an interior compartment for receiving and storing mail, the mailbox further including a mail deposit aperture in the top for inserting mail therethrough wherein the mail deposit aperture is in communication with the interior compartment, a movable lid attached to the mailbox for covering and uncovering the mail slot aperture, a locking device for locking and unlocking the openable top, a first signal light mounted to the front, and sound apertures formed in one of the sides;

an alarm system positioned within the interior compartment, the alarm system including a battery power supply, an impact and motion sensor, an antenna transmitter for transmitting radio wave signals, a magnetic switch device, and an audible speaker for emitting sound through the sound apertures, wherein the first signal light when illuminated indicates the alarm system is functioning;

a first receiver for receiving radio wave signals from the antenna transmitter, the receiver being located remote from the mailbox;

a remote control transmitter for activation and deactivation of the alarm system, the remote control transmitter adapted to be carried by an owner of the mailbox;

an outgoing mail holder for placement of outgoing mail therein, the outgoing mail holder being located remote from the mailbox and including a second receiver for receiving radio wave signals from the antenna transmitter, a display screen, a second signal light, an AC-DC power supply, and battery attachments for back-up battery power.

2. A rural security mailbox assembly comprising:

a mailbox having an openable front door, back, two sides, top, and bottom collectively defining an interior compartment for receiving and storing mail, the mailbox further including a mail deposit aperture in the door for inserting mail therethrough wherein the mail deposit aperture is in communication with the interior compartment, a locking device for locking and unlocking the door, a first signal light mounted to the door, and sound apertures formed in one of the sides;

an alarm system positioned within the interior compartment, the alarm system including a battery power supply, an impact and motion sensor, an antenna transmitter for transmitting radio wave signals, a magnetic switch device, and an audible speaker for emitting sound through the sound apertures, wherein the first signal light when illuminated indicates the alarm system is functioning;

a first receiver for receiving the radio wave signals from the antenna transmitter, the receiver being located remote from the mailbox;

a remote control transmitter for activation and deactivation of the alarm system, the remote control transmitter adapted to be carried by an owner of the mailbox; and an outgoing mail holder for placement of outgoing mail therein, the outgoing mail holder being located remote from the mailbox and including a second receiver for receiving the radio wave signals from the antenna transmitter, a display screen, a second signal light, an AC-DC power supply, and battery attachments for back-up battery power.

* * * * *